US007361037B2

(12) United States Patent
Kanazawa

(10) Patent No.: US 7,361,037 B2
(45) Date of Patent: Apr. 22, 2008

(54) CARD CONNECTOR WITH AN EJECT MECHANISM

(75) Inventor: Kunitoshi Kanazawa, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/711,731

(22) Filed: Feb. 28, 2007

(65) Prior Publication Data

US 2007/0207651 A1 Sep. 6, 2007

(30) Foreign Application Priority Data

Mar. 2, 2006 (JP) ..... 2006-056709

(51) Int. Cl.
*H01R 13/62* (2006.01)

(52) U.S. Cl. ..... 439/159; 439/630

(58) Field of Classification Search ..... 439/159, 439/630, 152

See application file for complete search history.

(56) References Cited

U.S. PATENT DOCUMENTS

| | | | | |
|---|---|---|---|---|
| 6,652,299 | B2 * | 11/2003 | Sato | 439/159 |
| 6,655,972 | B2 * | 12/2003 | Sato | 439/159 |
| 6,669,494 | B2 * | 12/2003 | Abe | 439/159 |

FOREIGN PATENT DOCUMENTS

| | | | |
|---|---|---|---|
| JP | 06-325820 | A | 11/1994 |
| JP | 11-238562 | A | 8/1999 |
| JP | 2001-143813 | A | 5/2001 |
| JP | 2003-045561 | A | 2/2003 |
| JP | 2003-203713 | A | 7/2003 |
| JP | 2005-044780 | A | 2/2005 |
| JP | 2005-044781 | A | 2/2005 |

* cited by examiner

*Primary Examiner*—Michael C. Zarroli
(74) *Attorney, Agent, or Firm*—Rader, Fishman & Grauer, PLLC

(57) ABSTRACT

A card connector is provided, which includes a group of contact pieces, a substantially rectangular and tabular housing, and an eject mechanism for extracting an IC card. The contact pieces are electrically connected to connecting terminals of the IC card. The housing supports the group of contact pieces. The eject mechanism is provided in the housing. The IC card is inserted and extracted in substantially parallel with one plane of the housing. The eject mechanism includes a pair of guiding walls lying opposite to each other adjacent to the contact pieces, an eject plate which can slide between the pair of guiding walls, and a cover plate for the eject plate. The eject plate includes at its first end portion a bent strip abutting an end portion of the IC card, and at its second end portion a pull-out strip allowing extraction of the IC card.

5 Claims, 7 Drawing Sheets

42
43
2
1
12a
12b
11
12
51
44a
44b
5
41
4
X

CARD CONNECTOR WITH AN EJECT MECHANISM

This application is based on and claims the benefit of priority from Japanese Patent Application No. 2006-056709, filed on 2 Mar. 2006, the content of which is incorporated herein by reference.

BACKGROUND OF THE INVENTION

1. Field of the Invention

The present invention relates to a card connector. More specifically, it relates to a card connector for compact IC cards such as SIM (Subscriber Identity Module) cards which are used for cellular phones.

2. Related Art

Recently, cellular phones have been widely used, which employ an installed SIM card on which user information such as user IDs and phone numbers has been recorded. The cellular phones become effective in communication only after insertion of an SIM card on which user information has been recorded, different from conventional cellular phones internally storing user information which has been recorded in advance.

In this case, the SIM card, which is an IC card that can be removed from a cellular phone, has an IC chip for sending, receiving, storing, and computing data using CPU's and memories. A user first records on the SIM card personal information, such as the user's phone number, user ID, and contractual information on a telecommunications company, which is required for the cellular phone to start working, and then inserts the SIM card into it.

For example, after insertion of a purchased SIM card, on which predetermined information has been recorded, into a cellular phone, the cellular phone becomes effective as the user's own cellular phone. In addition, the user can use this SIM card for another cellular phone with the same phone number. Moreover, the user can use plural SIM cards for one particular cellular phone.

In recent years, further miniaturization of the cellular phones has been accelerating. This has necessitated miniaturization of various parts due to a limited mounting area available for parts to be inserted within the cellular phone chassis. The same holds true of a unit for inserting SIM card. However, a conventional unit for inserting SIM card has included an eject mechanism having a complex structure for allowing the extraction of an SIM card. Due to the complexity of the eject mechanism a large number of parts are used, occupying a large footprint. As a result, it has been difficult to install the conventional eject mechanism in a compact cellular phone.

On the other hand, a slot-in type card connector, in which an eject mechanism is integrated with a connector electrically connected with an SIM card, has been disclosed (e.g., see Patent Document 1). This type of connector allows the eject mechanism to be installed in a cellular phone.

The card connector of Patent Document 1 has a frame in which the eject mechanism is installed. The frame includes a plastic base and a cover made of sheet metal. A space for inserting a card is defined by a bottom wall of the base and a top plate of the cover. The eject mechanism includes elastic elements made of wires attached to the base and a stopper structurally integral with the cover.

Patent Document 1: Japanese Unexamined Patent Application Publication No. 2003-045561

The card connector disclosed in Patent Document 1 provides the space for installing the eject mechanism in a cellular phone by introducing the eject mechanism attached to the connector. However, the eject mechanism has elastic elements providing an elastic force so as to release an inserted IC card. As a result, the card connecter requires a space, which allows movement of the elastic elements. This space raises a problem that an increased mounting area or an increased mounting height is required for a housing on a substrate. In addition, since the card connector has a cover over the housing instead of guiding elements for controlling insertion and extraction directions or a stopper, which prevents the card from coming out, the number of parts increases. Accordingly, an increase occurs in costs of parts and fabrication such as assembly.

SUMMARY OF THE INVENTION

Considering the aforementioned problems, the present invention has been made to provide a card connector including a simply configured eject mechanism which allows a reduction in the number of parts, the number of assembly steps, cost, and size.

The inventors have found that it is possible to achieve a reduction in size and simplification of a card connector, which is provided with an eject mechanism. Describing in more detail, an eject plate of the eject mechanism is slidably installed in a housing of the card connector. The eject plate includes a pull-out strip for extracting an IC card from the housing, and a bent strip, to which an end portion of the IC card abuts.

According to a first aspect of the present invention, a card connector is provided, which includes, a group of contact pieces, a substantially rectangular and tabular housing, and an eject mechanism for extracting an IC card. The group of contact pieces is electrically connected to connecting terminals of the IC card. The substantially rectangular and tabular housing supports the group of contact pieces. The eject mechanism is provided in the housing. The IC card is inserted and extracted in substantially parallel with one plane of the housing. The eject mechanism includes a pair of guiding walls lying opposite to each other adjacent to the group of contact pieces, an eject plate which can slide between the pair of guiding walls, and a cover plate attached to the housing so as to cover the eject plate. The eject plate includes at a first end portion thereof a bent strip abutting an end portion of the IC card, and at a second end portion thereof a pull-out strip allowing extraction of the IC card with respect to the housing.

The card connector described above includes: the group of contact pieces; and the substantially rectangular and tabular housing which is provided with the eject mechanism for extracting the IC card. Respective contact pieces are electrically connected to the connecting terminals of the IC card. The housing not only supports the respective contact pieces, but also has the eject mechanism for extracting the IC card.

In this case, the respective contact pieces are electrically conductive. It may be possible to adopt cantilevered contact pieces which functionally work like springs so long as the contact pieces are made of electrically conductive metal plates. In contrast, the housing has electrically insulative properties. It may be possible to adopt a substantially rectangular and tabular plate made of molded engineering plastics for the housing so long as it possesses electrically insulative properties.

The IC card is also called a chip card, which includes an SIM card. The IC card has an IC chip which is installed in a chassis made of electrically insulative plastics. The IC chip is connected to a plurality of pieces of metal foil attached to a surface of the chassis. The pieces of metal foil grouped into plural units serve as connecting terminals of the IC card.

It should be noted that the description that the group of contact pieces electrically connected with the connecting terminals of the IC card is meant to include such an electrical connection that contact points of the contact pieces urge pressure on the connecting terminals of the IC card so as to establish electrical continuity. In addition, the housing to support the contact pieces includes an arrangement, in which a base portion of a contact piece or a fixed arm to be described later is supported by the housing. The arrangement may include full or partial support for the base portion of the contact piece and the fixed arm.

The eject mechanism includes the pair of guiding walls, which is formed approximately parallel with the insertion and extraction directions of the IC card; the eject plate, which can slide between the pair of guiding walls; and the cover plate which is attached to the housing so as to partially cover the eject plate. The pair of guiding walls may be provided in a plane opposite to the IC card to be inserted and extracted. In addition, the pair of guiding walls may be arranged so that the eject plate can slide between the guiding walls in the insertion and extraction directions of the IC card, for example, approximately parallel with the insertion and extraction directions.

The eject plate has a substantially rectangular shape. The eject plate has at its first end portion the bent strip which the end portion of the IC card abuts, and at its second end portion the pull-out strip for sliding the eject plate so as to extract the IC card abutting the bent strip. The length of the eject plate in a sliding direction is determined to be substantially the same as the length of the IC card in the insertion and extraction directions. For example, when an approximately rectangular IC card is inserted in its longitudinal direction, the length of the eject plate should be substantially the same as the longitudinal length of the IC card. On the other hand, when the IC card is inserted in its lateral direction, the length of the eject plate should be substantially the same as the lateral length of the IC card. The pull-out strip should be arranged so that the eject plate can be pulled out after insertion of the IC card, and may be bent in an opposite direction to an aperture of the insertion slot of the chassis. The bent strip should be arranged so as to support the end portion of the IC card, and may be bent in an opposite direction to the pull-out strip. Note that the end portion of the IC card includes a rear surface of the IC card with respect to its extraction direction. In addition, a structural configuration represented by the description, the end portion of the IC card abutting the bent strip, includes full and partial abutting of the IC card.

The cover plate is attached to the housing so as to support the eject plate. A height of the cover plate while mounted is so arranged that the cover plate is substantially flash with the housing. Note that to support the eject plate includes not only guidance of sliding for the eject plate, but also prevention of disengagement of the eject plate from the housing. In addition, the bent strip of the eject plate comes to abut the cover plate at a predetermined position, while sliding in the extraction direction, thereby controlling a shifting distance of the eject plate. In this connection, the predetermined position coincides with where the eject plate is withdrawn far enough to extract the IC card.

The card connector according to the first aspect of the present invention has the eject mechanism for extracting the IC card, therefore increasing freedom in designing the chassis. In other words, it is possible to reduce in size the chassis of cellular phone and the like. In addition, the eject mechanism has the pair of guiding walls which lie in a recess provided in the housing. The eject plate is placed between the guiding walls so as to be allowed to slide. Accordingly, there is no need for an elastic element such as a spring and movable space for the elastic element, allowing reduction in size of the card connector and the space it occupies. This allows for a reduction in the size of the occupied area of the connector on the board. In addition, the simplified configuration of the eject mechanism allows a decrease in the number of parts and assembly cost, resulting in a reduction in the fabrication cost.

According to a second aspect of the present invention, the eject plate includes a pair of protrusions spaced each other that protrude towards the cover plate. The cover plate includes an engaging hole which engages with the pair of protrusions. A first protrusion engages with the engaging hole when the IC card is inserted, and a second protrusion engages with the engaging hole when the IC card is withdrawn.

The card connector described above includes the pair of protrusions spaced each other protruding towards the cover plate. A protrusion may be provided adjacent to the bent strip and the other protrusion adjacent to the pull-out strip. In addition, the cover plate includes the engaging hole which engages with the protrusions. When the IC card is inserted, the first protrusion engages with the engaging hole of the cover plate so as to restrain the movement and to support the eject plate. In contrast, when the IC card is withdrawn, the second protrusion engages with the engaging hole so as to restrain the movement and to support the eject plate. This allows for the control of undesirable movement of the eject plate such as slipping out during insertion and ejection of the eject plate, thereby preventing damage to the eject plate.

According to a third aspect of the present invention, the card connector is mounted on a printed circuit board.

According to a fourth aspect of the present invention, the IC card includes an SIM card.

According to a fifth aspect of the present invention, a cellular phone includes a card connector. The card connector includes a group of contact pieces that are electrically connected to connecting terminals of an IC card, a substantially rectangular and tabular housing that supports the group of contact pieces, and an eject mechanism for extracting the IC card provided in the housing. The IC card is inserted and extracted in substantially parallel with one plane of the housing. The eject mechanism includes a pair of guiding walls lying opposite to each other adjacent to the group of contact pieces, an eject plate which can slide between the pair of guiding walls, and a cover plate attached to the housing so as to cover the eject plate. The eject plate includes at a first end portion thereof a bent strip abutting an end portion of the IC card, and at a second end portion thereof a pull-out strip allowing extraction of the IC card with respect to the housing.

According to the present invention, it is possible to provide a card connector including a simply configured eject mechanism that allows for a reduction in the number of parts, number of assembly steps, cost, and size.

BRIEF DESCRIPTION OF THE DRAWINGS

FIG. 1A is a front view, FIG. 1B is a plan view, FIG. 1C is a bottom view, FIG. 1D is a left side view and FIG. 1E is a right side view;

FIG. 2A is a front view and FIG. 2B is a right side view;

FIG. 5A is a front view and FIG. 5B is a plan view;

FIG. 7A is a front view and FIG. 7B is a right side view; FIG. 8A is a front view, and FIG. 8B is a right side view.

DETAILED DESCRIPTION OF THE INVENTION

An embodiment of the present invention is described forthwith with reference to the drawings.

Figures 1A, 1B, 1C, 1D, 1E:
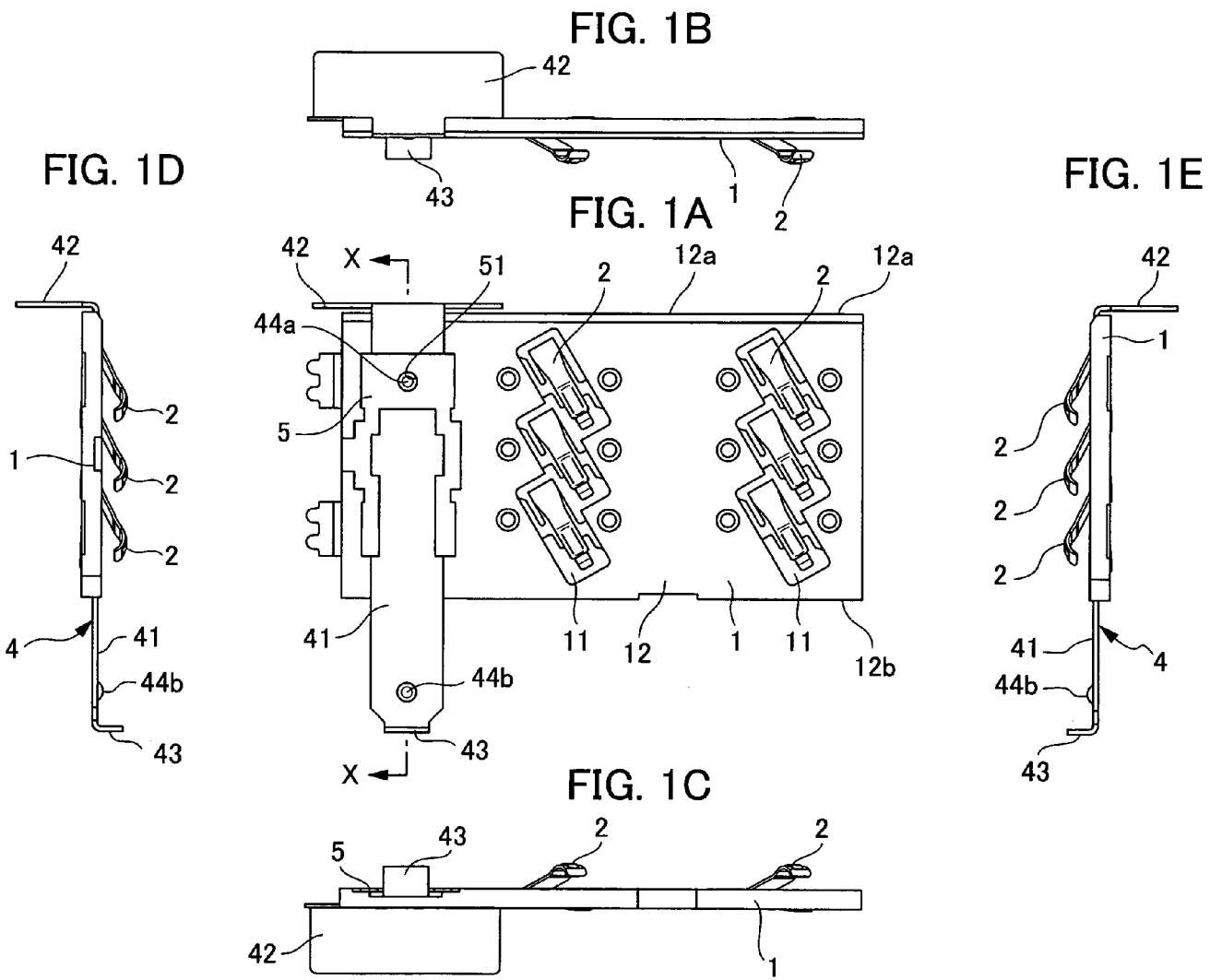
FIG. 1A to FIG. 1E each show a card connector according to an embodiment of the present invention.
Figure 2B:
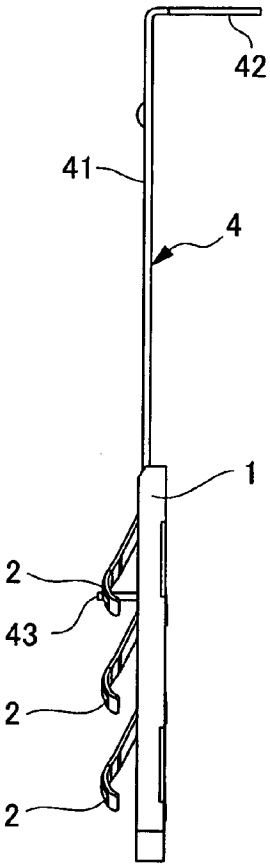
FIG. 2A and FIG. 2B each show an eject plate of the card connector according to the embodiment, which has been withdrawn.
Figure 2A:
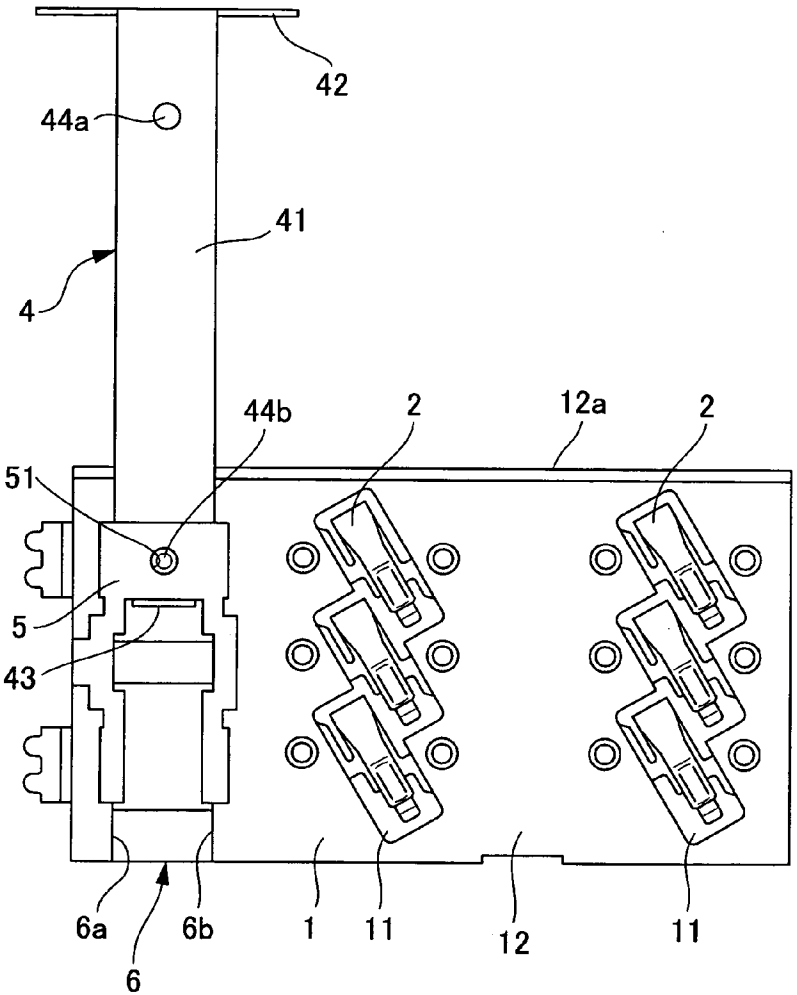
Figure 3:
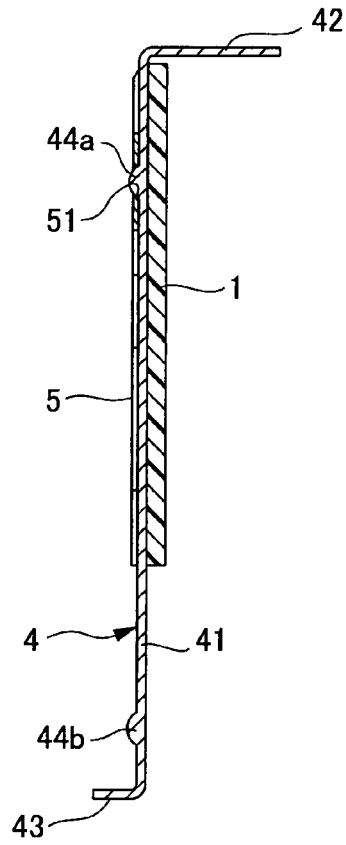
FIG. 3 is a cross-sectional view along the line X-X represented in FIG. 1.

A configuration of a card connector 100 according to the embodiment of the present invention is described. As shown in FIGS. 1 through 3, the card connector 100 includes a substantially rectangular and tabular housing 1, and six contact pieces 2. The housing 1 includes an eject mechanism 3 that can slide in insertion and extraction directions of an SIM card (IC card) 7. Each contact piece 2 is electrically connected to the SIM card (IC card) 7. The housing 1 with electrically insulative properties is molded from engineering plastics into a substantially rectangular plate. Each contact piece 2 is an electrically conductive metal plate which has a shape of a cantilever so as to work like a spring. Each contact piece 2 is molded into the housing 1.

Figure 4:
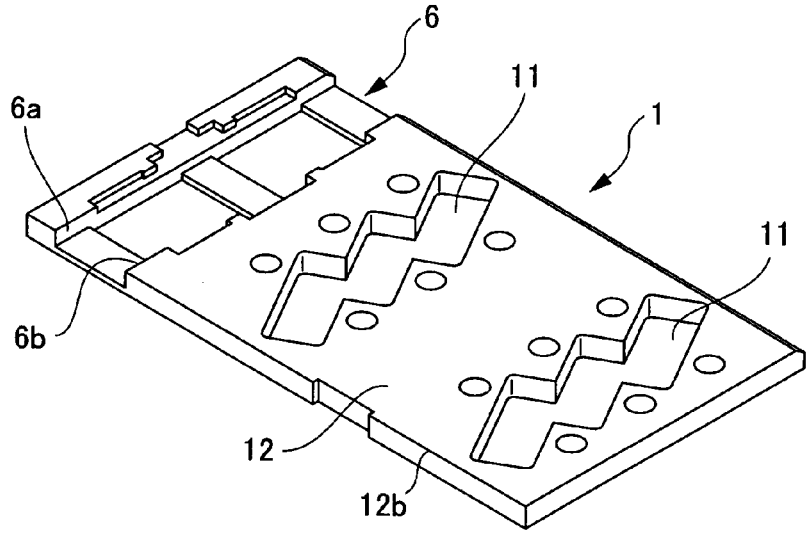
FIG. 4 is a perspective view showing a housing according to the embodiment.

In FIG. 4, the housing 1, which has a substantially rectangular shape, includes contact supporting regions 11, each providing attachment for contact pieces 2. Each contact supporting region 11 supports the contact pieces 2. A guiding groove 6 of the eject mechanism 3, which will be described later, lies adjacent to the contact supporting regions 11. The eject mechanism 3 includes an eject plate 4, a cover plate 5, and the guiding groove 6 having a pair of guiding walls 6*a* and 6*b*.

Figure 5A:
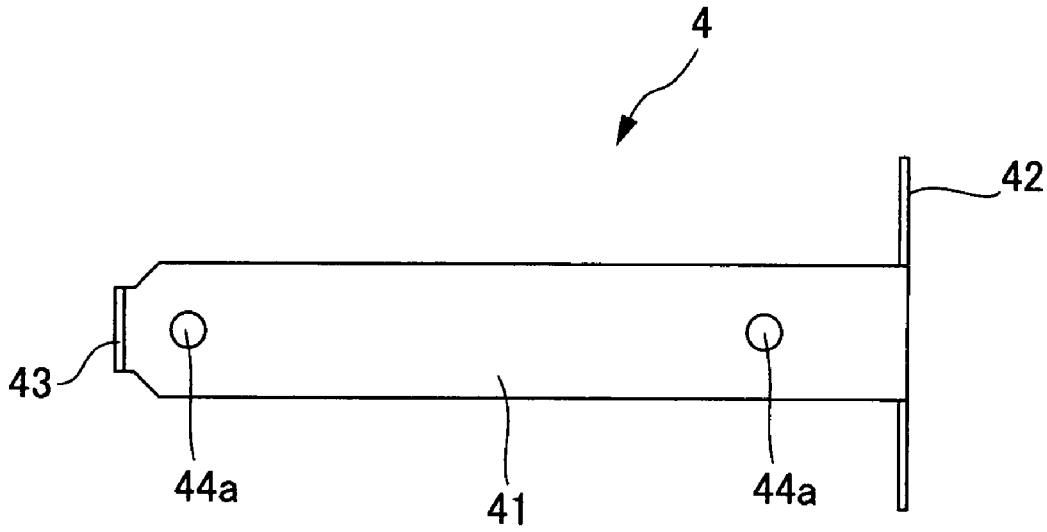
FIG. 5A and FIG. 5B each show the eject plate according to the embodiment.
Figure 5B:
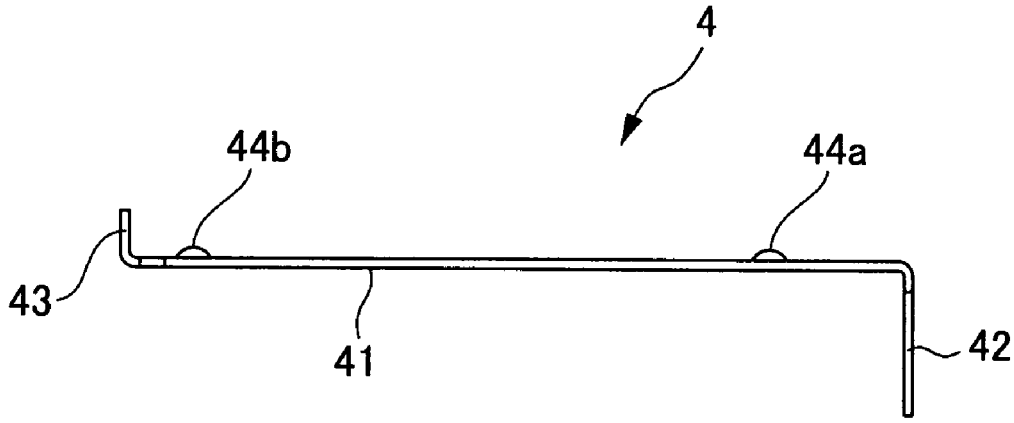

As shown in FIG. 5A and FIG. 5B, the eject plate 4, which is made of metal plate, includes a main body 41, a pull-out strip 42 provided at one end portion of the main body 41, and a bent strip 43 provided at the other end portion.

The main body 41 has a shape of a substantially rectangular plate. A length in a lateral direction, that is, a width of the main body 41 is determined to be substantially the same as a distance between the guiding walls 6*a* and 6*b* facing each other. A length in a longitudinal direction is determined to be substantially the same as a length in insertion and extraction directions of the SIM card (IC card) 7. The pull-out strip 42 is placed at one end portion of the main body 41 in the longitudinal direction. The pull-out strip 42 having a substantially rectangular shape is structurally integrated with the main body 41. The pull-out strip 42 is bent in a depth direction of the guiding groove 6 of the housing 1, and abuts a part of the periphery of the housing 1. In addition, the bent strip 43 is placed at the other end portion of the main body 41 in the longitudinal direction. The bent strip 43 having a substantially rectangular shape is structurally integrated with the main body 41. The bent strip 43 is bent in an opposite direction to the pull-out strip 42, and abuts an end portion of the SIM card (IC card) 7. The main body 41 has protrusions 44*a* and 44*b*, which protrude towards the cover plate 5 and lie adjacent to the pull-out strip 42 and the bent strip 43, respectively.

The guiding groove 6 has the pair of guiding walls 6*a* and 6*b*. The guiding walls 6*a* and 6*b* are side walls of the guiding groove 6, which is recessed a predetermined depth in a plane 12 of the housing 1 and which runs in a direction of insertion of the SIM card (IC card) 7. Here, the plane 12 is where the contact pieces 2 are attached for providing electrical connection for the connecting terminals of the SIM card (IC card) 7. In addition, the predetermined depth may be so determined as to be deep enough to allow the eject plate 4 to slide, which is partially covered by the cover plate 5.

The cover plate 5 has an engaging hole 51 in a supporting portion for the eject plate 4. The engaging hole 51 engages with the protrusions 44*a* and 44*b*, respectively. More specifically, one protrusion 44*a* engages with the engaging hole 51 when the SIM card (IC card) 7 is inserted. On the other hand, the other protrusion 44*b* engages with the engaging hole 51 when the SIM card (IC card) 7 is withdrawn.

A contact piece 2 is a tabular contact piece made of a metal plate, and has a fixed arm and an elastic arm. The contact piece 2 has a shape similar to a character of V, which results from combining respective rear base portions of the fixed arm and the elastic arm. Here, "a shape similar to a character of V" includes an arrangement in which the elastic arm is placed in a diagonal direction with respect to the fixed arm. In addition, the contact piece 2 is cantilevered so that a load is exerted on a tip of the elastic arm while the rear base portion of the elastic arm is supported. Note that it is preferable, but not necessarily, that the rear base portions of the fixed and elastic arms are attached to each other in an arc. This allows for a reduction in centralized stress with respect to a load exerted on the elastic arm.

The elastic arm has a shape of a slender plate, a tip of which is shaped in a gentle arc. An arc-shape contact point is provided at the tip of the elastic arm. The fixed arm includes a pair of extended strips (not shown), and has a solder junction (not shown) at the tip of a strip. The contact piece 2 is molded into the housing 1 with the extended strips (not shown).

In this way, the contact piece 2 is supported by the housing 1 so that a contact point of the elastic arm protrudes from one plane of the housing 1. Here, the description that the contact point protrudes from one plane of the housing 1 includes an arrangement, in which the elastic arm partially protrudes from one plane of the housing 1. The SIM card (IC card) 7 is inserted in parallel with this plane 12 (see FIG. 6).

Figure 6:
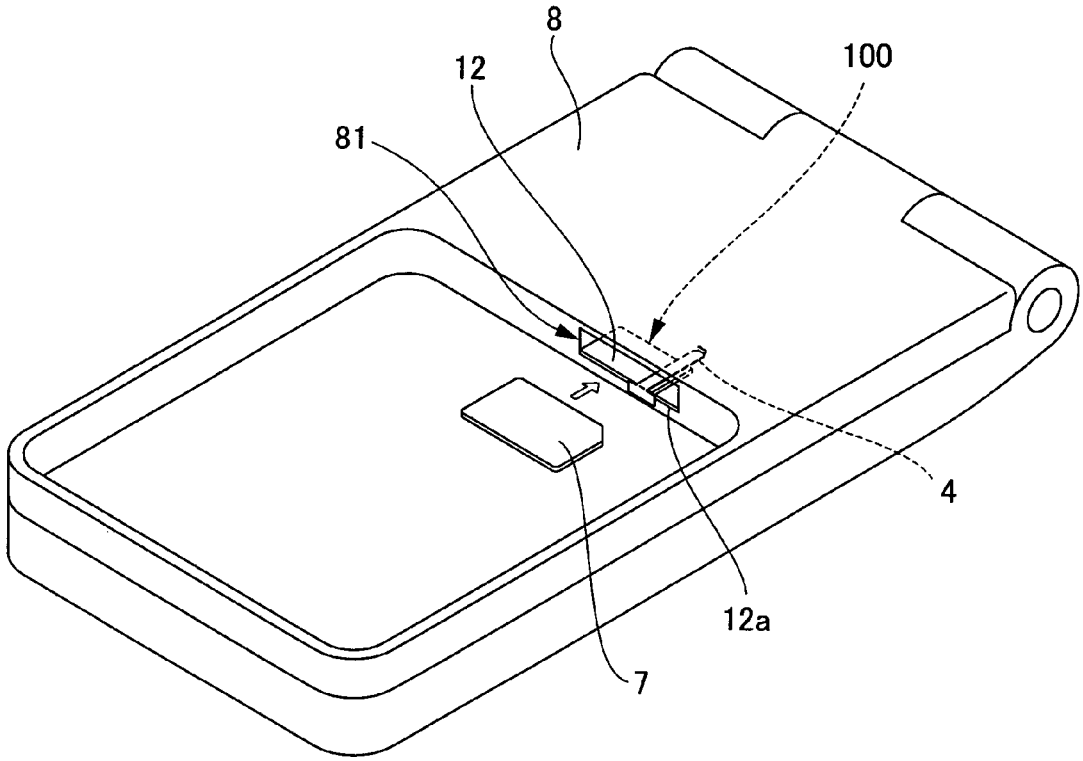
FIG. 6 is a schematic diagram illustrating an SIM card which is inserted into a cellular phone, in which the card connector, according to the embodiment, has been installed.
Figure 7B:
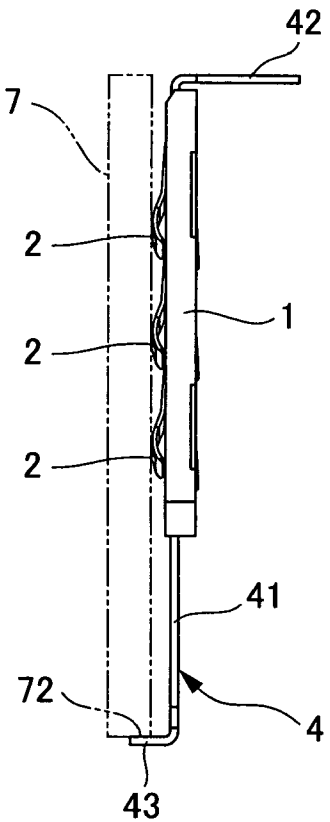
FIG. 7A and FIG. 7B each show an SIM card connected with a card connector when the SIM card is inserted into the cellular phone in FIG. 6.
Figure 7A:
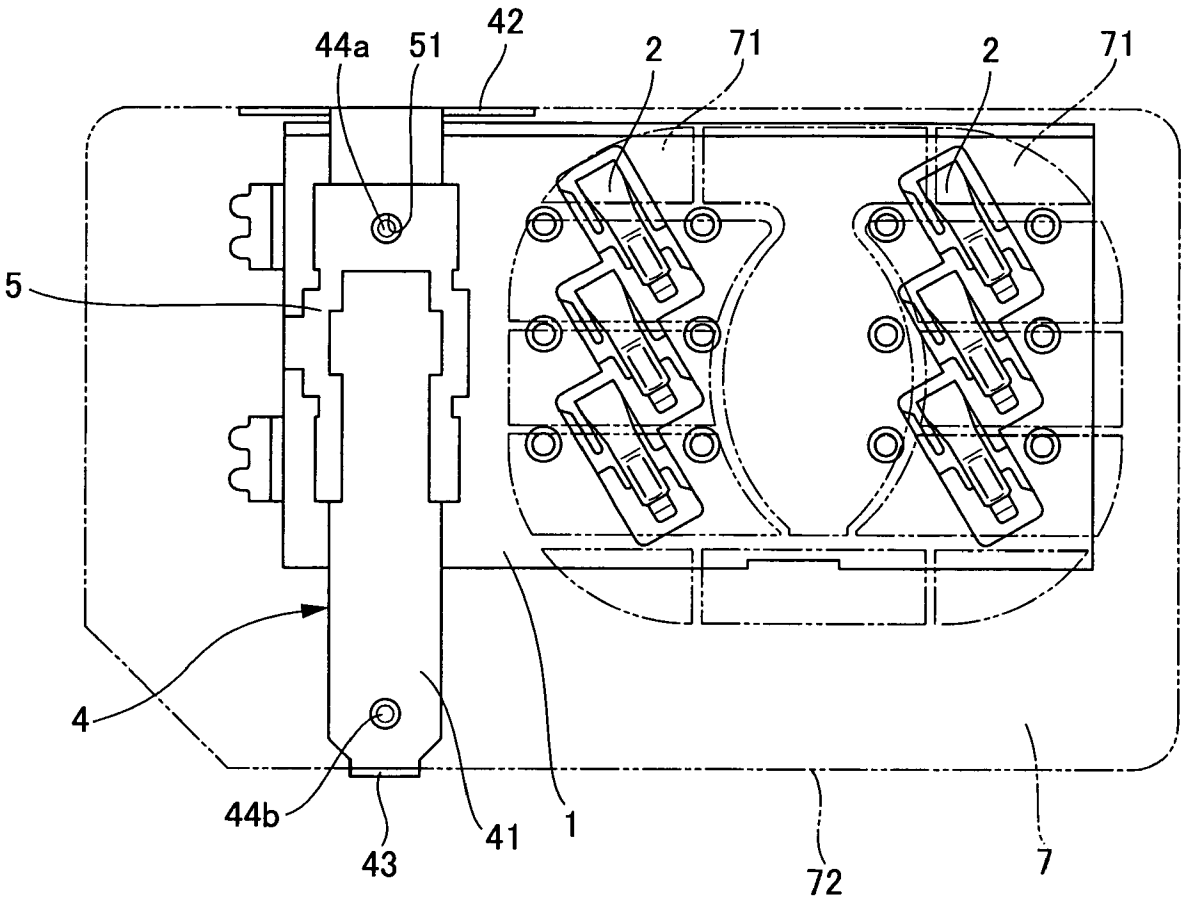
Figure 8B:
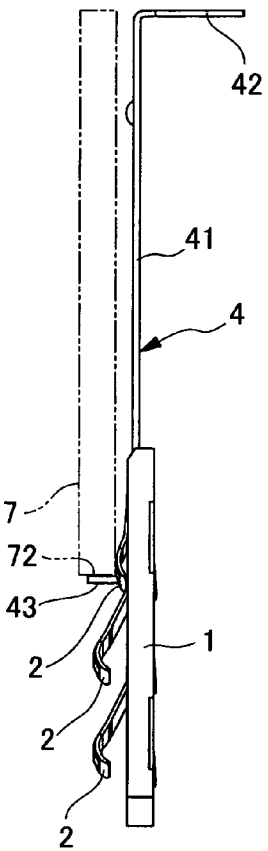
FIG. 8A and FIG. 8B each show an eject plate which has been withdrawn so as to extract an SIM card inserted in the cellular phone of FIG. 6.
Figure 8A:
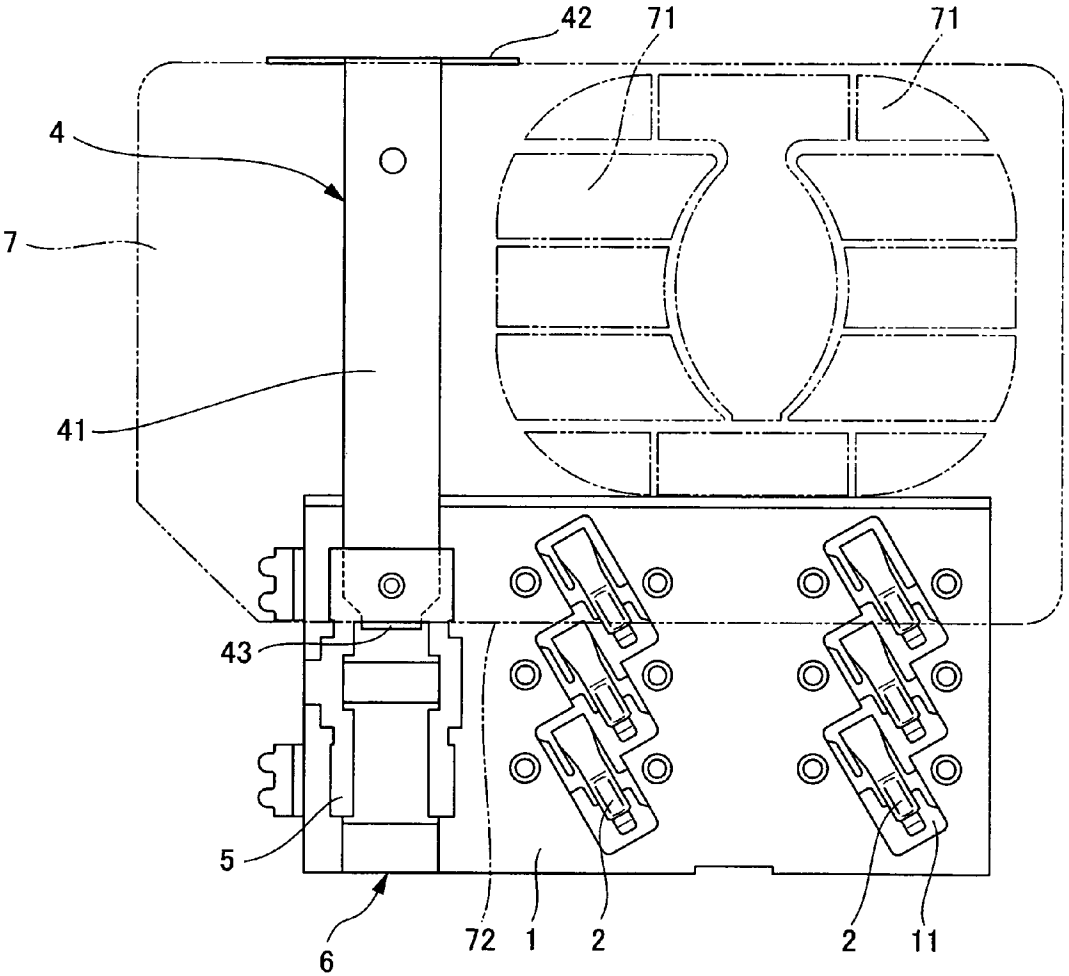

Insertion and extraction of the SIM card (IC card) 7 are described with reference to FIGS. 6 through 8. In FIG. 6, the card connector 100 according to the embodiment is mounted on a printed circuit board (not shown) provided within a chassis of a cellular phone 8. More specifically, the card connector 100 is mounted on the printed circuit board so that a first side 12*a* of the housing 1 is parallel to a longitudinal side, which is one of sides defining a rectangular insertion slot 81 of the cellular phone 8. The SIM card (IC card) 7 inserted through the insertion slot 81 is then electrically connected to the cellular phone 8 while the connecting terminals 71 come into contact with the respective contact pieces 2 of the card connector 100.

First, insertion of the SIM card (IC card) 7 is described. In FIG. 7, an end portion 72 of the SIM card (IC card) 7 inserted through the insertion slot 81 abuts the bent strip 43 of the eject plate 4. Since the pull-out strip 42 is bent in an opposite direction to the bent strip 43, that is, in an opposite direction to the aperture of the insertion slot 81, the pull-out strip 42 thus makes contact with the external surface of the insertion slot 81 of the cellular phone 8. In this way, the pull-out strip 42 prevents a sliding movement of the eject plate 4 in excess of a predetermined distance. This determines an insertion distance for the SIM card (IC card) 7. In addition, one protrusion 44*a* provided on the main body 41 engages with the engaging hole 51 formed in the cover plate 5. This also restricts the sliding movement of the eject plate 4. Moreover, a movement of the SIM card (IC card) 7 towards insertion and extraction directions is restricted by a force towards the chassis exerted by the contact pieces 2.

Next, extraction of the SIM card (IC card) 7 is described. In FIG. 8, the SIM card (IC card) 7, which is mounted on the housing 1 and the eject plate 4 in the cellular phone 8, is extracted from the cellular phone 8 by withdrawing the pull-out strip 42. More specifically, when the pull-out strip 42 is withdrawn, the eject plate 4 slides along the guiding groove 6. The SIM card (IC card) 7, whose end portion abuts the bent strip 43, slides along with the eject plate 4. Note that by applying a certain force to the pull-out strip 42 in an extraction direction, one protrusion 44*a* disengages from the engaging hole 51. This allows sliding of the eject plate 4, so that the SIM card (IC card) 7 is withdrawn from the cellular phone 8. When the slid eject plate 4 moves a predetermined distance, the other protrusion 44*b* engages with the engaging hole 51, thereby restricting further sliding of the eject plate 4 in the extraction direction. As described above, when the eject plate 4 is withdrawn the predetermined distance from the insertion slot 81, the SIM card (IC card) 7 is withdrawn accordingly, allowing the SIM card (IC card) 7 to be extracted from the cellular phone 8.

As described above, according to the card connector 100 of the embodiment, it is possible to provide a card connector including a simply configured eject mechanism, which allows reduction in number of parts, number of assembly steps, cost, and size. This is achieved by the eject plate 4 which is slidably installed in the housing 1, and which includes the pull-out strip 42 that allows the SIM card (IC card) 7 to be extracted from the housing 1, and the bent strip 43 which abuts the end portion of the SIM card (IC card) 7.

While the embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A card connector comprising:

a group of contact pieces which are electrically connected to connecting terminals of an IC card;

a substantially rectangular and tabular housing which supports the group of contact pieces; and an eject mechanism for extracting the IC card, the eject mechanism being provided in the housing;

wherein the IC card is inserted and extracted in substantially parallel with one plane of the housing, wherein the eject mechanism includes a pair of guiding walls lying opposite to each other adjacent to the group of contact pieces, an eject plate which can slide between the pair of guiding walls, and a cover plate attached to the housing so as to cover the eject plate, wherein the eject plate includes at a first end portion thereof a bent strip abutting an end portion of the IC card, and at a second end portion thereof a pull-out strip allowing extraction of the IC card with respect to the housing, wherein the eject plate includes a pair of protrusions spaced each other that protrude towards the cover plate, the cover plate includes an engaging hole which engages with the pair of protrusions, a first protrusion engages with the engaging hole when the IC card is inserted, and a second protrusion engages with the engaging hole when the IC card is withdrawn.

2. The card connector of claim 1, wherein the card connector is mounted on a printed circuit board.

3. The card connector of claim 1, wherein the IC card includes a Subscriber Identity Module card.

4. The card connector according to claim 1, wherein the card connector is applied to a cellular phone.

5. A cellular phone comprising:

a card connector including a group of contact pieces that are electrically connected to connecting terminals of an IC card, a substantially rectangular and tabular housing that supports the group of contact pieces, and an eject mechanism for extracting the IC card provided in the housing, wherein the IC card is inserted and extracted in substantially parallel with one plane of the housing, wherein the eject mechanism includes a pair of guiding walls lying opposite to each other adjacent to the group of contact pieces, an eject plate which can slide between the pair of guiding walls, and a cover plate attached to the housing so as to cover the eject plate, wherein the eject plate includes at a first end portion thereof a bent strip abutting an end portion of the IC card, and at a second end portion thereof a pull-out strip allowing extraction of the IC card with respect to the housing, and wherein the eject plate includes a pair of protrusions spaced each other that protrude towards the cover plate, the cover plate includes an engaging hole which engages with the pair of protrusions, a first protrusion engages with the engaging hole when the IC card is inserted, and a second protrusion engages with the engaging hole when the IC card is withdrawn.

* * * * *